US011118832B2

(12) United States Patent
Choy et al.

(10) Patent No.: US 11,118,832 B2
(45) Date of Patent: Sep. 14, 2021

(54) SHELF ASSEMBLY WITH WATER DISPENSER AND FILTRATION SYSTEM

(71) Applicant: WHIRLPOOL CORPORATION, Benton Harbor, MI (US)

(72) Inventors: Kaito Choy, Chicago, IL (US); Daniel Lottinville, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 121 days.

(21) Appl. No.: 16/386,653

(22) Filed: Apr. 17, 2019

(65) Prior Publication Data

US 2020/0333064 A1 Oct. 22, 2020

(51) Int. Cl.
*F25D 23/12* (2006.01)
*F25D 25/02* (2006.01)

(52) U.S. Cl.
CPC ..... *F25D 23/126* (2013.01); *F25D 25/02* (2013.01); *F25D 2323/121* (2013.01); *F25D 2400/18* (2013.01)

(58) Field of Classification Search
CPC .. F25D 23/126; F25D 25/02; F25D 2323/121; F25D 2400/18
See application file for complete search history.

(56) References Cited

U.S. PATENT DOCUMENTS 2,788,642 A 4/1957 Burkhead et al.
3,024,621 A * 3/1962 Parker ..... F25D 23/126 62/339
3,982,406 A * 9/1976 Hanson ..... F25D 23/126 62/339
5,156,021 A 10/1992 St-Gelais et al.
6,810,682 B1 * 11/2004 Schuchart ..... F25D 23/126 222/146.6
7,673,471 B2 3/2010 Egan et al.
9,915,468 B2 * 3/2018 You ..... F25D 25/025
10,946,319 B2 * 3/2021 Subrahmanya ..... C02F 1/008
2004/0231353 A1 11/2004 Schuchart et al.
2007/0278141 A1 12/2007 Patera et al.
(Continued)

FOREIGN PATENT DOCUMENTS

EP 1752723 A2 2/2007
KR 101153136 B1 6/2012
WO 2015071849 A1 5/2015

*Primary Examiner* — Kun Kai Ma
(74) *Attorney, Agent, or Firm* — Price Heneveld LLP

(57) ABSTRACT

A refrigerator includes a refrigerator compartment having a rear wall with an inwardly angled portion. A first and second shelf assemblies are disposed within the refrigerator compartment. The first shelf assembly includes a panel supported on a frame assembly to define a cavity positioned below a portion of the panel. The second shelf assembly includes front and top panels that cooperate with a surface of the inwardly angled portion of the rear wall to define a storage cavity therebetween. A water filtration system includes a water filter assembly laterally disposed within the storage cavity of the second shelf assembly. A water dispenser system includes a dispenser paddle operably coupled to the first shelf assembly and interconnected to the water filter assembly by a water supply line that is concealed within the cavity of the first shelf assembly by the opaque portion of the panel of the first shelf assembly.

17 Claims, 10 Drawing Sheets

(56) References Cited

U.S. PATENT DOCUMENTS

| | | | | |
|---|---|---|---|---|
| 2009/0288439 | A1* | 11/2009 | Ihle | B01D 35/30 62/317 |
| 2011/0056222 | A1* | 3/2011 | Lee | F25D 23/126 62/129 |
| 2014/0230481 | A1* | 8/2014 | Yun | B67D 1/0894 62/340 |
| 2014/0283542 | A1* | 9/2014 | Jang | F25D 23/126 62/340 |
| 2016/0341462 | A1* | 11/2016 | Kim | F25D 23/04 |
| 2017/0174493 | A1 | 6/2017 | Aranda et al. | |
| 2017/0211875 | A1* | 7/2017 | Lee | H01F 38/14 |
| 2018/0118203 | A1 | 5/2018 | Seo et al. | |
| 2018/0118548 | A1 | 5/2018 | Lux et al. | |
| 2018/0209718 | A1* | 7/2018 | Staud | F25D 23/025 |
| 2020/0208904 | A1* | 7/2020 | Choy | B67D 3/0093 |
| 2020/0256614 | A1* | 8/2020 | Bertolini | F25D 25/02 |

* cited by examiner

SHELF ASSEMBLY WITH WATER DISPENSER AND FILTRATION SYSTEM

BACKGROUND

The present device generally relates to a water dispenser, and more specifically, to a refrigerator having an internal water dispenser with water supply lines provided through a shelf assembly of the refrigerator along with a shelf concealed filtration system.

SUMMARY

In at least one aspect, a refrigerator includes a refrigerator compartment that is at least partially defined by a liner having a sidewall. A shelf assembly is disposed within the refrigerator compartment and includes a frame assembly supporting a panel. The panel includes first and second portions. The shelf assembly is supported on the liner, such that a first side portion of the frame assembly is disposed adjacent to and substantially parallel with the sidewall of the liner. A dispenser paddle includes a first portion operably coupled to the frame assembly of the shelf assembly. A second portion of the dispenser paddle extends downwardly from the first portion of the dispenser paddle. A water supply line is operably coupled to the dispenser paddle below the second portion of the panel.

In at least another aspect, a shelf assembly includes a frame assembly having first and second side portions interconnected by front and rear portions. The frame assembly further includes an intermediate member disposed between the first and second side portions which interconnects the front and rear portions to define a cavity therebetween. A panel is supported on the frame assembly and includes a portion covering the cavity of the frame assembly. A water supply line is disposed within the cavity of the frame assembly.

In at least another aspect, a refrigerator includes a refrigerator compartment having a rear wall. The rear wall includes an inwardly angled portion. A first shelf assembly is disposed within the refrigerator compartment and includes a panel supported on a frame assembly to define a cavity positioned below a portion of the panel. A second shelf assembly is disposed within the refrigerator compartment. The second shelf assembly includes a front panel and a top panel that cooperate with a surface of the inwardly angled portion of the rear wall to define a storage cavity therebetween. A water filtration system includes a water filter assembly laterally disposed within the storage cavity. A water dispenser system includes a dispenser paddle operably coupled to the first shelf assembly and interconnected with the water filter assembly by a water supply line.

These and other features, advantages, and objects of the present device will be further understood and appreciated by those skilled in the art upon studying the following specification, claims, and appended drawings.

DETAILED DESCRIPTION OF EMBODIMENTS

Figure 1:
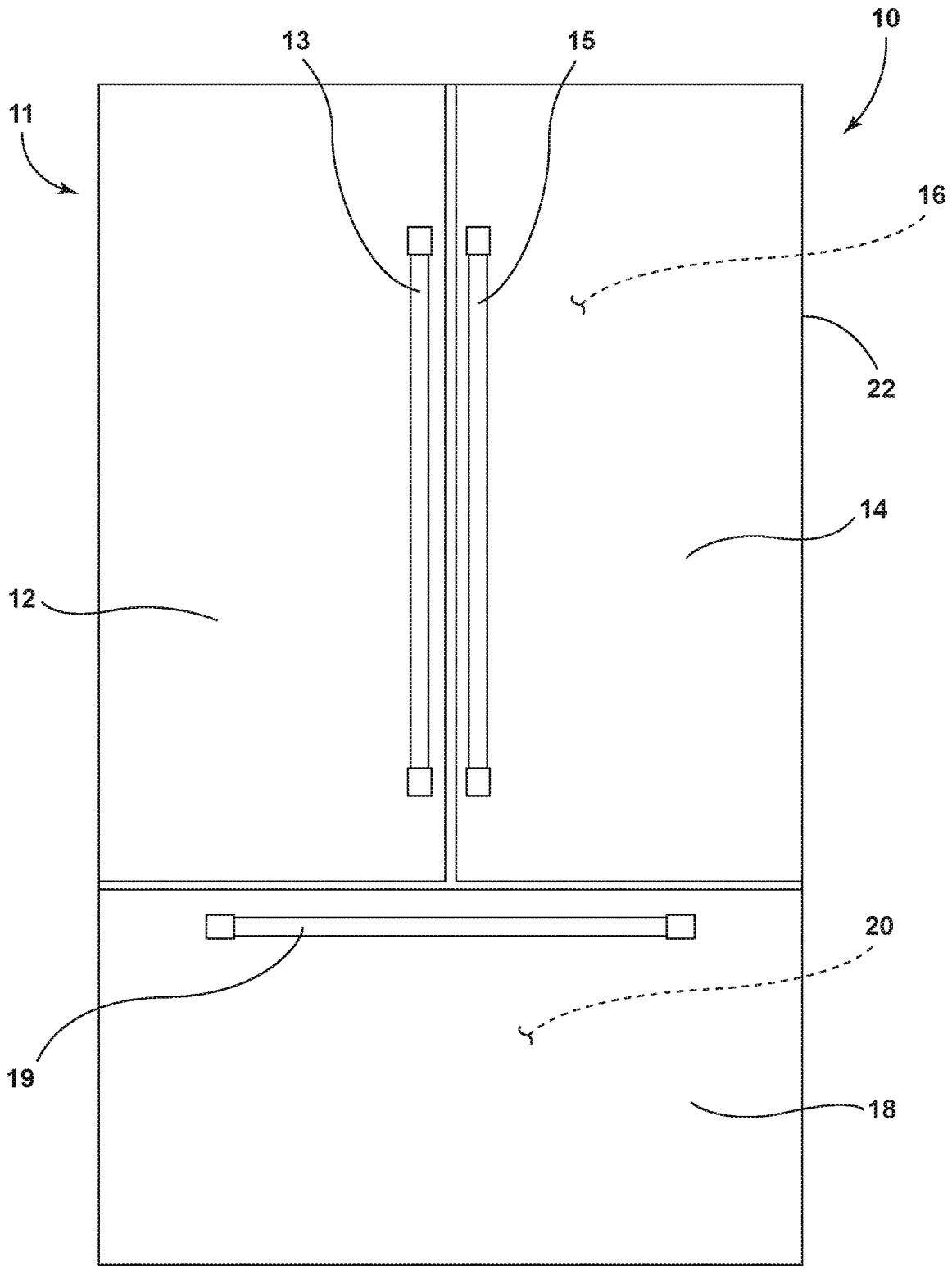
FIG. 1 is a front plan view of a refrigerator.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
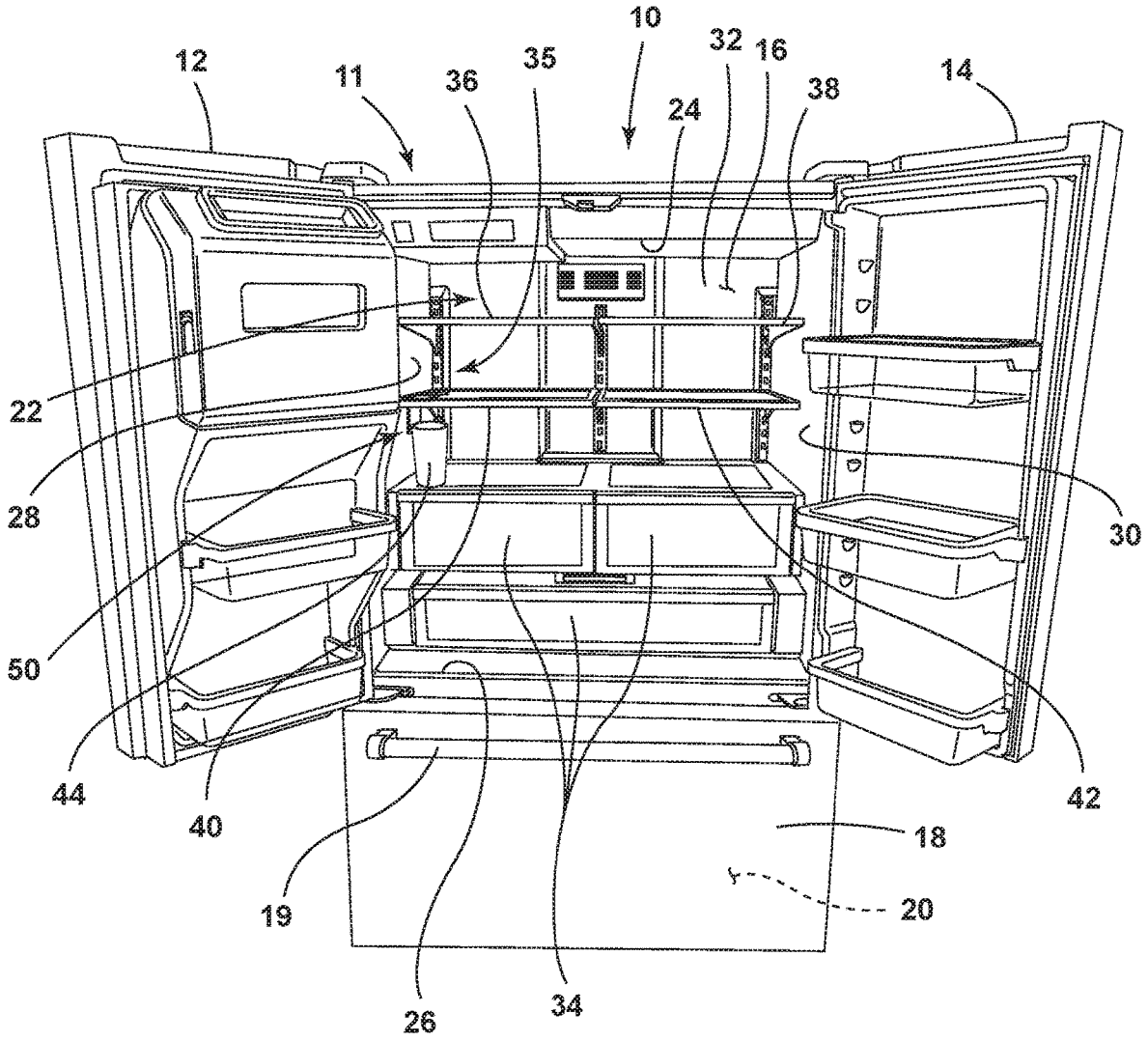
FIG. 2 is a top perspective view of the refrigerator of FIG. 1 with refrigerator doors shown in an open position to reveal a refrigerator compartment.

Referring now to FIG. 1, reference numeral 10 generally designates an appliance shown in the form of a refrigerator having a cabinet structure 11 (FIG. 2). As shown in FIG. 1, the refrigerator 10 includes first and second doors 12, 14 that are disposed in a French-style door configuration and are pivotally coupled to the cabinet structure 11 for selectively providing access to a refrigerator compartment 16. The first and second doors 12' include handles 13, 15, respectively, which are configured to allow a user to selectively move the first and second doors 12, 14 between open and closed positions, either separately or together. The refrigerator 10 shown in FIG. 1 also includes a lower pull-out freezer drawer 18 having a handle 19 that selectively provides access to a freezer compartment 20. It will generally be understood that the concepts, as set forth herein, can be applied to any appliance having any general refrigerator configuration.

Referring now to FIG. 2, the refrigerator 10 is shown with the doors 12, 14 in an open position to reveal the refrigerator compartment 16. The usable space of the refrigerator compartment 16 is generally defined by a liner 22 having a top wall 24 that is spaced-apart from a bottom wall 26. The top wall 24 and the bottom wall 26 of the liner 22 are interconnected by first and second sidewalls 28, 30 of the liner 22 which are laterally spaced-apart from one another. The Top wall 24 and the bottom wall 26 of the liner are also interconnected by a rear wall 32. The rear wall 32 of the liner 22 defines a rear wall of the refrigerator compartment 16. It is contemplated that the rear wall of the refrigerator compartment 16 may also be defined by a wall covering assembly used to conceal components of the refrigerator 10 as further described below with reference to FIGS. 5A-5C.

In the embodiment shown in FIG. 2, a number of drawers 34 are shown disposed within the refrigerator compartment 16 at a lower portion thereof. The embodiment shown in FIG. 2 also includes a number of shelf assemblies 36, 38, 40 and 42. In the embodiment shown in FIG. 2, the shelf assemblies 36, 38, 40 and 42 of the refrigerator 10 are shown as being adjustably supported on a rack system 35 disposed on the rear wall 32 of the liner 22. However, it is contemplated that the shelf assemblies 36, 38, 40 and 42 could be suspended from any portion of the liner 22 (such as the sidewalls 28, 30 thereof) within the refrigerator compartment 16. Further, any number of configurations for the shelf assemblies, drawers and storage compartments of the refrigerator compartment 16 are contemplated for use with the present concept. As further shown in FIG. 2, a water dispenser assembly 50 is shown disposed on shelf assembly 40 near a cup 44. The water dispenser assembly 50 is disposed within the refrigerator compartment 16, and therefore defines an internal water dispenser assembly, as further described below.

Figure 3A:
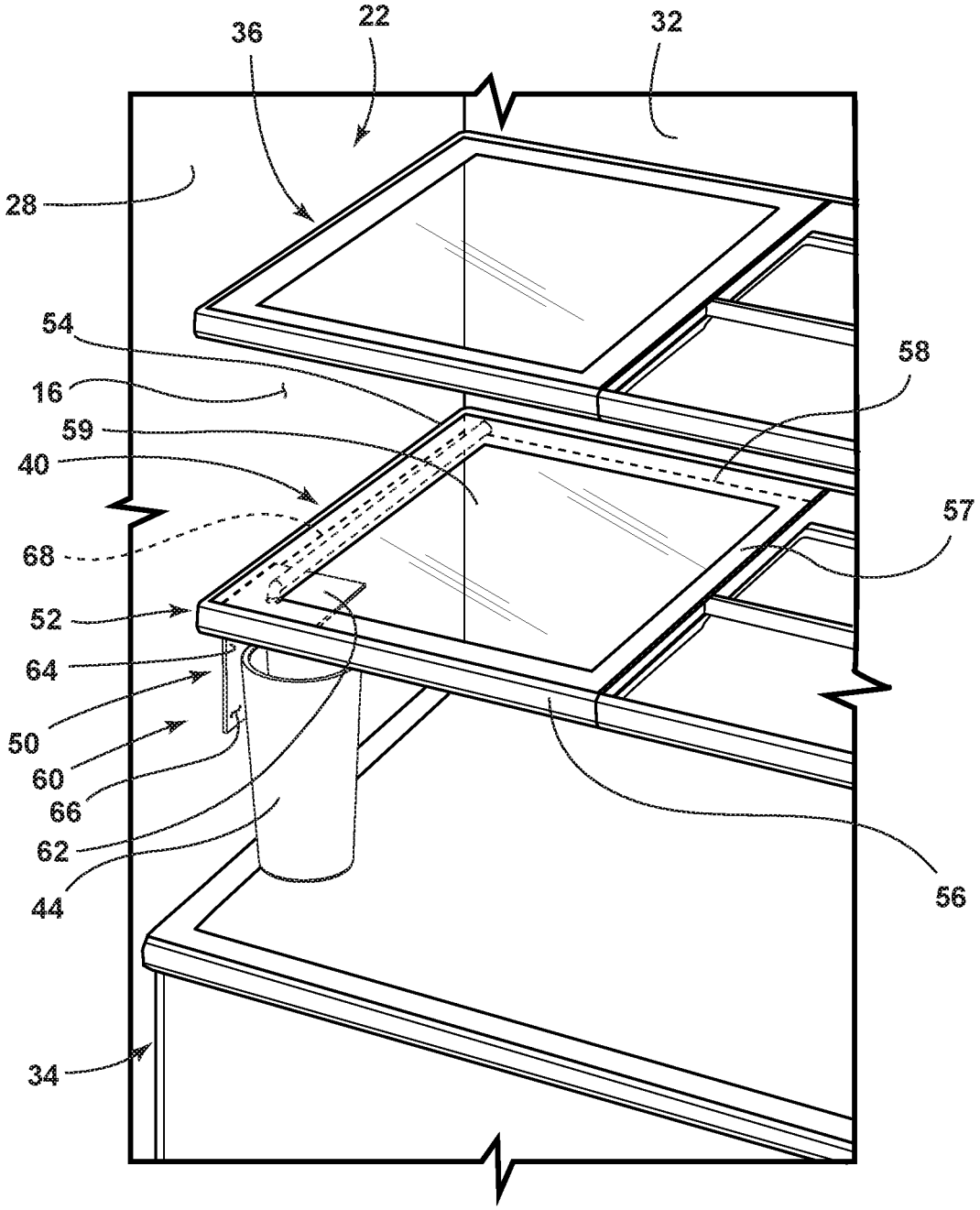
FIG. 3A is a top perspective view of the refrigerator compartment of FIG. 2 showing a shelf assembly having a water dispenser system.

Referring now to FIG. 3A, shelf assembly 40 is shown having a frame assembly 52 which surrounds and supports a panel 59. The panel 59 is contemplated to be a transparent or translucent panel comprised of a light transmissive glass or polymeric material. The frame assembly 52 includes a first side portion 54 and a second side portion 57 which are interconnected by front and rear portions 56, 58. As shown in FIG. 3A, the first side portion 54 of the frame assembly 52 is disposed adjacent to the first sidewall 28 of the liner 22. As further shown in FIG. 3A, the rear portion 58 of the frame assembly 52 is disposed adjacent to the rear wall 32 of the liner 22.

As noted above, the shelf assembly 40 includes a water dispenser assembly 50 incorporated therein. In the embodiment shown in FIG. 3A, the water dispenser assembly 50 includes a dispenser paddle 60 disposed at a front portion of the shelf assembly 40. As disposed near the front portion of the shelf assembly 40, the dispenser paddle 60 is readily accessible when a user opens the doors 12, 14 of the refrigerator 10. The dispenser paddle 60 includes a first portion 62 operably coupled to the shelf assembly 40 at an underside of the shelf assembly. The first portion 62 of the dispenser paddle 60 may be coupled to the frame assembly 52 or the panel 59 of the shelf assembly 40. Particularly, the first portion 62 of the dispenser paddle 60 may be coupled to the frame assembly 52 of the shelf assembly 40 at the first side portion 54 or the front portion 56 of the frame assembly 52. As further shown in FIG. 3A, the dispenser paddle 60 also includes a second portion 64, wherein the second portion 64 extends downwardly from the first portion 62. Thus, the first portion 62 of the dispenser paddle 60 is operably coupled to a bottom surface of the shelf assembly 40, such that the first portion 62 of the dispenser paddle 60 is generally disposed in a horizontal plane that is parallel to a plane in which the shelf assembly 40 is horizontally disposed. The second portion 64 of the dispenser paddle 60 is positioned in a substantially parallel relationship with respect to the first sidewall 28 of the liner 22. Thus, the second portion 64 of the dispenser paddle 60 is disposed in a substantially vertical plane. As illustrated in FIG. 3A, the first and second portions 62, 64 of the dispenser paddle 60 are substantially perpendicular to one another. In this way, the dispenser paddle 60 is configured in such a way as to define a receiving area 66 disposed between the first and second portions of the dispenser paddle 60. Specifically, the receiving are 66 defined by the dispenser paddle 60 is positioned vertically below the first portion 62 of the dispenser paddle 60 and inwardly from the second portion 64 of the dispenser paddle 60. In the embodiment shown in FIG. 3A, the cup 44 is disposed in the receiving area 66 defined by the dispenser paddle 60. In use, a user will use a cup, such as cup 44, or other like receptacle, to engage the second portion 64 of the dispenser paddle 60 to initiate a water filling sequence, as further described below.

Water is contemplated to be supplied to the water dispenser assembly 50 using a water supply line 68 which is shown in phantom in FIG. 3A. The water supply line 68 is contemplated to be substantially concealed by a portion of the frame assembly 52, such as the first portion 54 of the frame assembly 52 of shelf assembly 40. The frame assembly 52 may also include a trim member covering the water supply line 68 as the water supply line 68 extends from the rear portion 58 of the frame assembly 52 to the front of the shelf assembly 40. Further, the water supply line 68 is contemplated to extend through the rear portion 58 of the frame assembly 52 and through the rear wall 32 of the liner 22 to connect to a water supply source, as further described below.

Figure 3B:
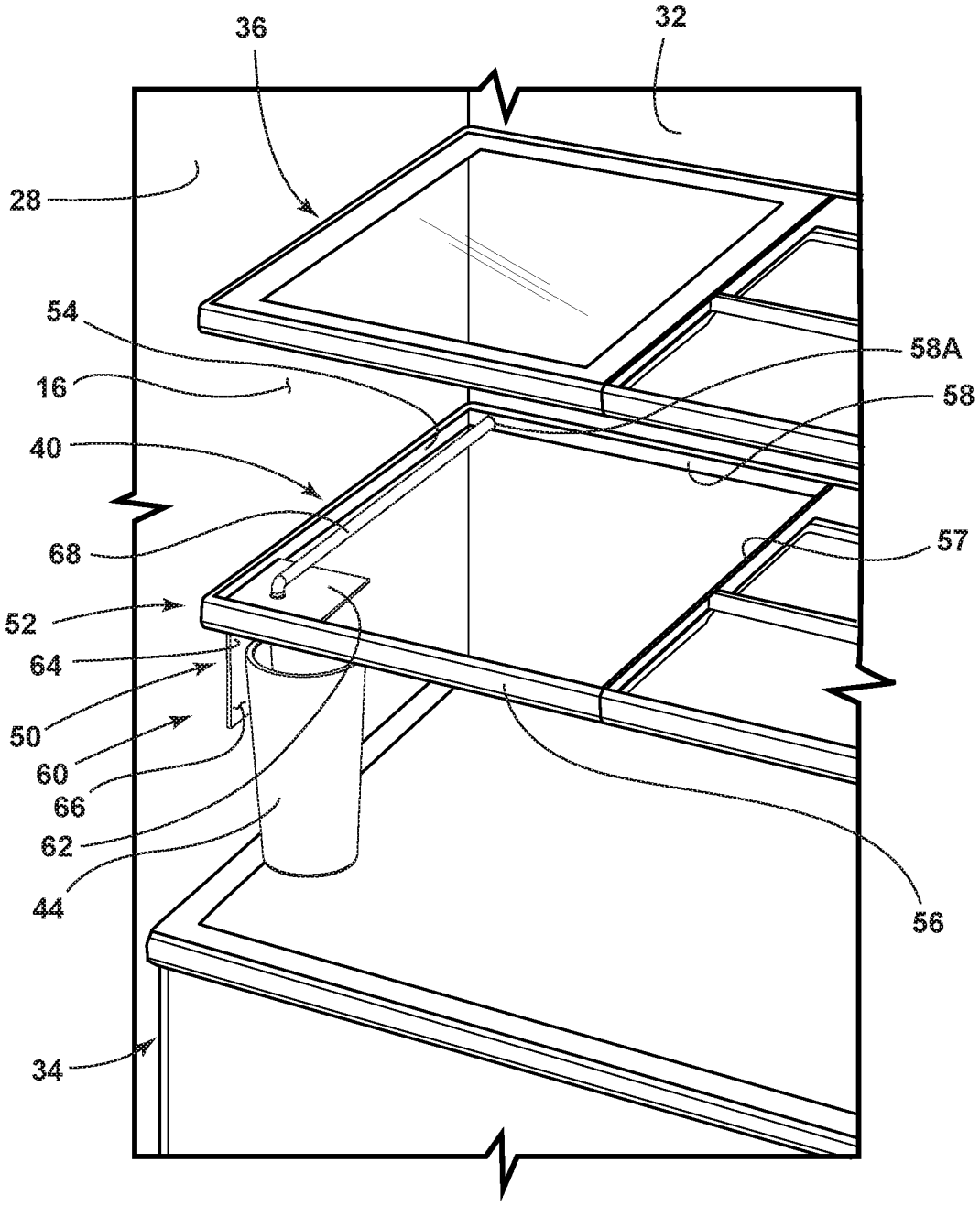
FIG. 3B is a top perspective view of the shelf assembly of FIG. 3A with portions of the shelf assembly removed to reveal a supply line of the water dispenser system.

Referring now to FIG. 3B, the panel 59 has been removed along with trim portions of the frame assembly 52 to reveal the water supply line 68 and the dispenser paddle 60 incorporated into the shelf assembly 40. The water supply line 68 is shown extending through an access aperture 58A disposed through the rear portion 58 of the frame assembly 52. With the panel 59 (FIG. 3A) removed, the water supply line 68 and the dispenser paddle 60 are fully revealed. It is contemplated that the panel 59 may include a tinted or opaque portion which covers and conceals the water supply line 68 and the dispenser paddle 60 when the panel 59 is in place, as further described below with reference to FIGS. 5A-5C.

Figure 4A:
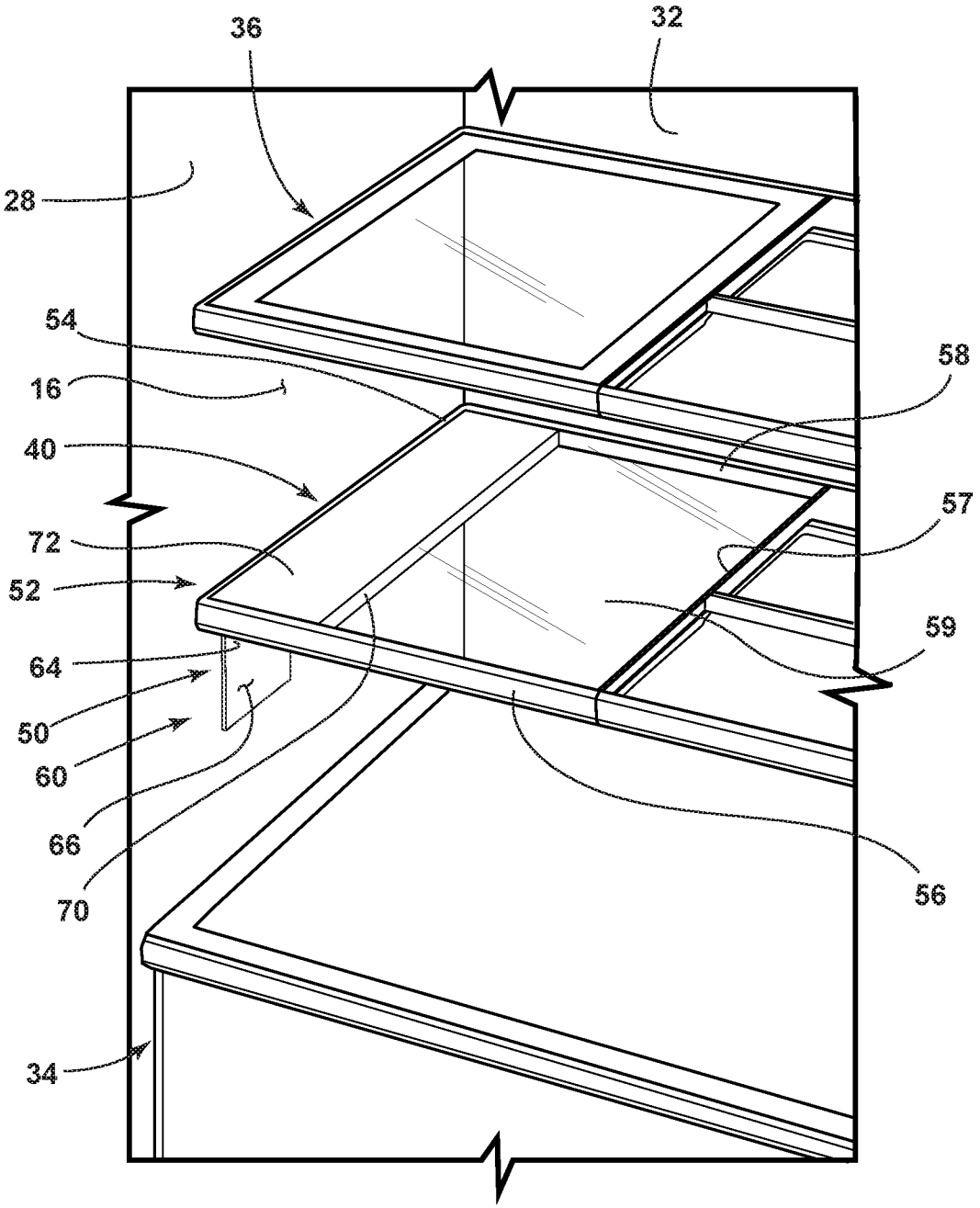
FIG. 4A is a top perspective view of the refrigerator compartment of FIG. 2 showing a shelf assembly having a water dispenser system.

Referring now to FIG. 4A, the frame assembly 52 of the shelf assembly 40 is shown having an intermediate member 70 disposed between the first and second side portions 54, 57 of the frame assembly 52. The intermediate member 70 interconnects the front and rear portions 56, 58 of the frame assembly 52. The frame assembly 52 of the shelf assembly 40 shown in FIG. 4A also includes a panel 59 which is supported by the front and rear portions 56, 58 of the frame assembly 52 along with the intermediate member 70 and the second side portion 57 of the frame assembly 52. A trim member 72 is disposed along a side of the shelf assembly 40. Specifically, the trim member 72 is disposed between the first side portion 54 and the intermediate member 70 of the frame assembly 52. In assembly, the trim member 72 covers and conceals the dispenser paddle 60 (FIG. 4B) as well as the water supply line 68 (FIG. 4B), such that the water dispenser assembly 50 is substantially concealed as incorporated into the shelf assembly 40. In a manner as described above, the trim member 72 may be incorporated into the panel 59 as an opaque portion of the panel 59. The trim member 72 and the panel 59 may also be separate and distinct parts of the shelf assembly 40 supported by the frame assembly 52 thereof.

Figure 4B:
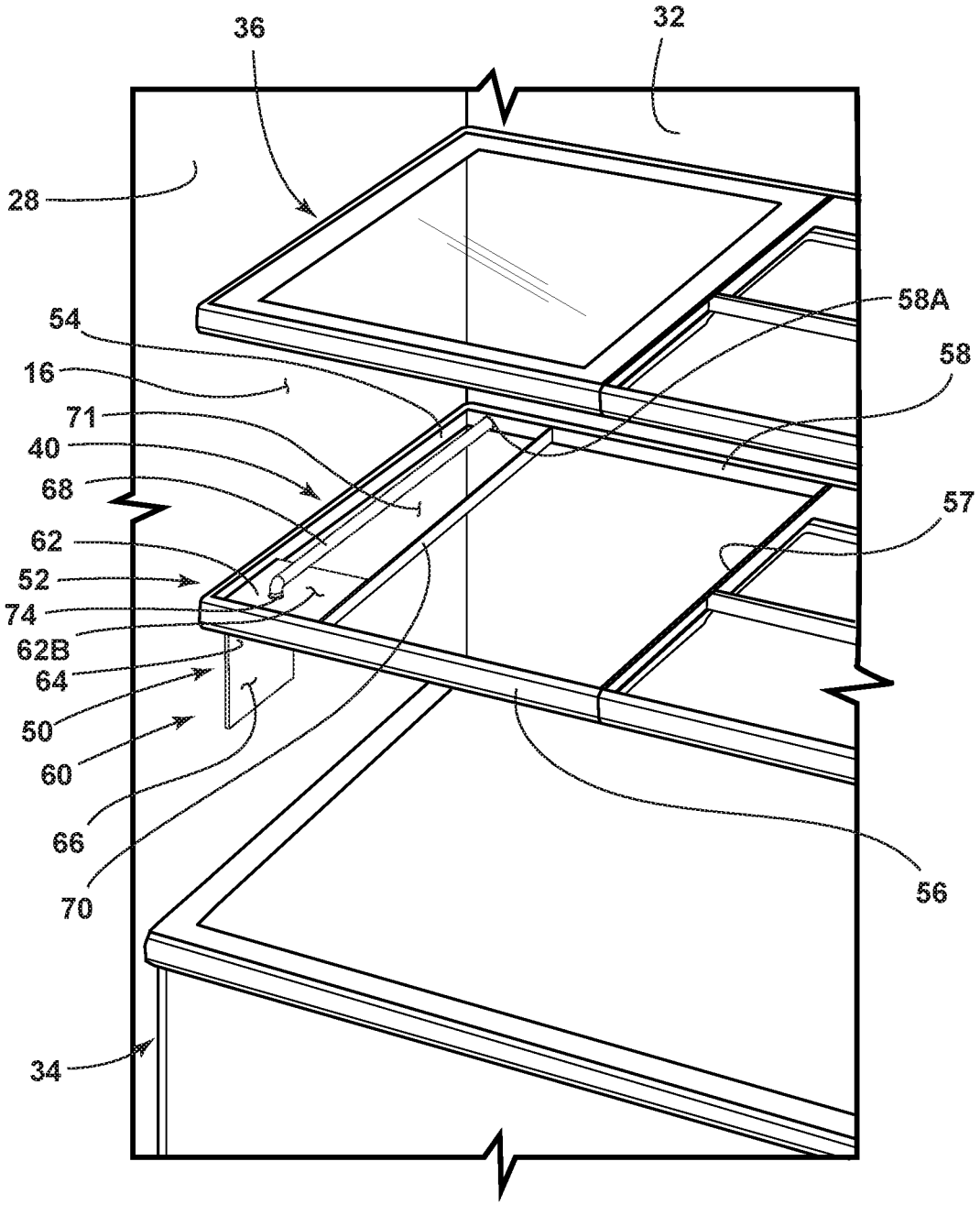
FIG. 4B is a top perspective view of the shelf assembly of FIG. 4A with portions of the shelf assembly removed to reveal a supply line of the water dispenser system.

Referring now to FIG. 4B, the trim member 72 and the panel 59 have been removed from the shelf assembly 40, such that the water supply line 68 is revealed along with an outer surface 62B of the first portion 62 of the dispenser paddle 60. As specifically shown in FIG. 4B, the water supply line 68 is shown disposed within a cavity 71 that is generally defined by the frame assembly 52 and covered by the trim member 72 or the panel 59 in assembly. The first portion 62 of the dispenser paddle 60 includes an access aperture 74 disposed therethrough. The water supply line 68 is shown as being disposed through the access aperture 74 of the first portion 62 of the dispenser paddle 60. In this way, the water dispenser assembly 50 of the present concept is configured to provide water to the receiving area 66 positioned between the first and second portions 62, 64 of the dispenser paddle 60.

Figure 4C:
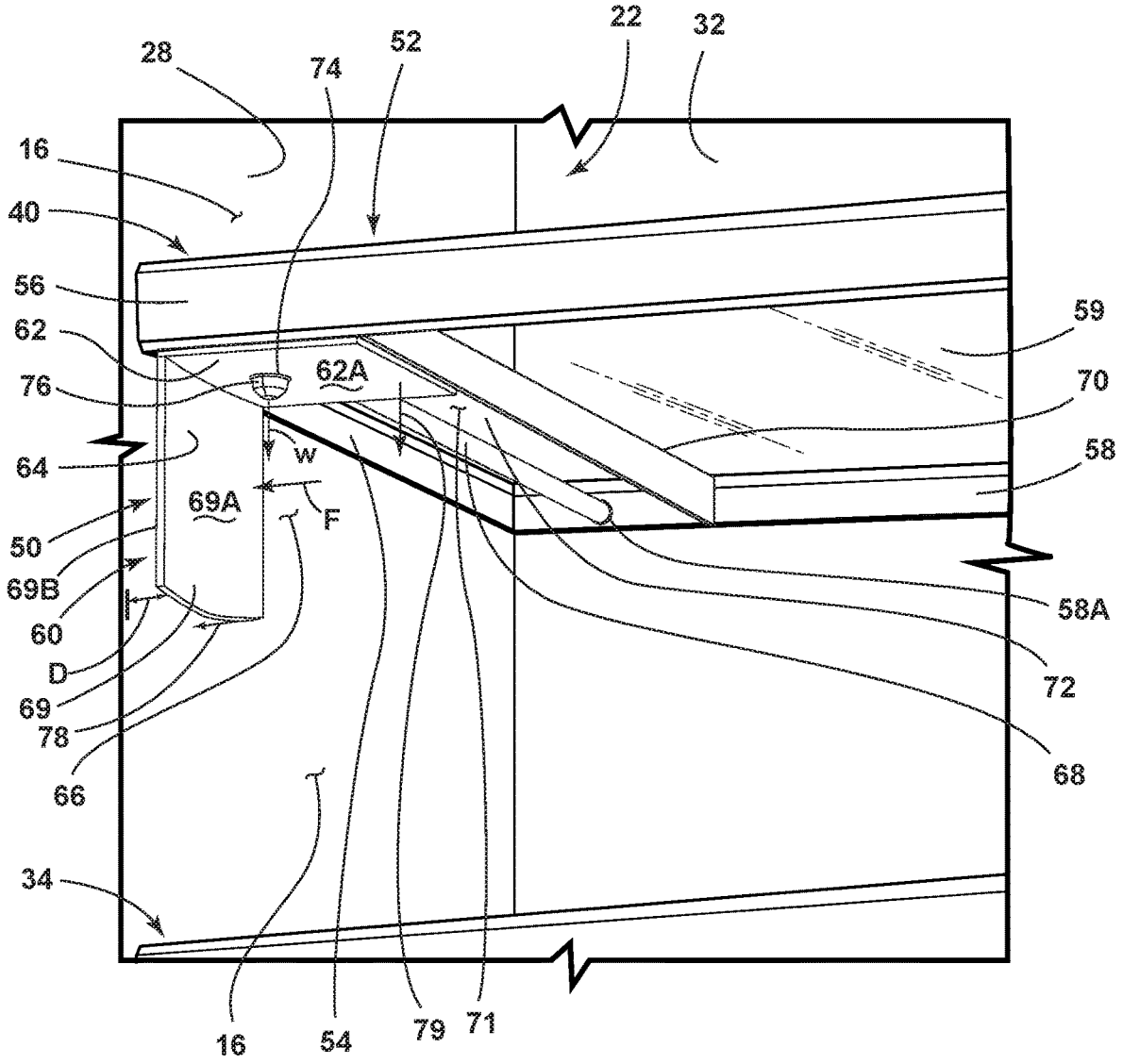
FIG. 4C is a bottom perspective view of the shelf assembly of FIG. 4A showing a dispenser paddle of the water dispenser system.

Referring now to FIG. 4C, the water supply line 68 is shown as extending through the access aperture 58A disposed through the rear portion 58 of the frame assembly 52. A nozzle 76 is shown disposed on an inner surface 62A of the first portion 62 of the dispenser paddle 60 and is contemplated to interconnect with the water supply line 68 for dispensing water into the receiving area 66 when a water dispensing sequence is initiated by a user engaging the dispenser paddle 60. As further shown in FIG. 4C, the second portion 64 of the dispenser paddle 60 includes a body portion 69 having an inner surface 69A and an outer surface 69B. The outer surface 69B is disposed a distance D from the first sidewall 28 of the liner 22. As shown in FIG. 4C, the body portion 69 of the second portion 64 of the dispenser paddle 60 is positioned closely adjacent to the first sidewall 28 of the liner 22. In this way, the dispenser paddle 60 is positioned to take up very little space within the refrigerator compartment 16. It is contemplated that the second portion 64 of the dispenser paddle 60 can move outwardly in the direction as indicated by arrow 78 between first and second positions. In FIG. 4C, the second portion 64 of the dispenser paddle 60 is contemplated to be in an at-rest or first position. In use, a user can use a receptacle, such as the cup 44 shown in FIGS. 3A and 3B, to inwardly press along the inner surface 69A of the body portion 69 of the second portion 64 of the dispenser paddle 60 to move the second portion 64 of the dispenser paddle 60 from the first position to an outwardly disposed second position. The second position of the second portion 64 of the dispenser paddle 60 is contemplated to be an actuated position caused by a pressing force of a user acting on the body portion 69 of the second portion 64 of the dispenser paddle 60 in an outward direction as indicated by arrow F to initiate a water dispensing sequence from the nozzle 76 disposed directly above the receiving area 66. It is contemplated that the second portion 64 of the dispenser paddle 60 may be hingedly coupled to the first portion 62 of the dispenser paddle 60 for outward movement in the direction as indicated by arrow 78 between the first and second positions described above. Further, it is contemplated that the first and second portions 62, 64 of the dispenser paddle 60 may be fixedly coupled to one another as a unitary whole, such that the first portion 62 moves downwardly in the direction as indicated by arrow 79 when the second portion 64 is moved from the first position to the second position in the initiation of a water dispensing sequence. In such an arrangement, it is contemplated that the dispenser paddle 60 is pivotally coupled to the shelf assembly 40, for example at the frame assembly 52 thereof, to allow for lateral movement of the second portion 64 of the dispenser paddle 60 between the at-rest and actuated positions. When the second portion 64 articulates relative to the first portion 62, it is contemplated that the first portion 62 is fixedly mounted to the shelf assembly 40, while the second portion 64 is pivotally coupled to the first portion 62. In either arrangement, it is contemplated that the dispenser paddle 60, at least the second portion 64 thereof, is biased towards the at-rest position.

In a water dispensing sequence, is contemplated that a user will take a receptacle, such as cup 44 shown in FIGS. 3A, 3B, and engage the second portion 64 of the dispenser paddle 60 at the inner surface 69A of the body portion 69 thereof by applying an outwardly directed force indicated by arrow F (FIG. 4C). It is contemplated that the second portion 64 of the dispenser paddle 60 is operably coupled to an electronic switch, such that the engagement of the second portion 64 of the dispenser paddle 60 by a user will send an electronic signal to a controller when the second portion 64 of the dispenser paddle 60 is moved to the second or actuated position from the first or at-rest position. It is contemplated that the switch may be disposed in the dispenser paddle 60 to detect movement of the second portion 64 between at-rest and actuated positions. It is contemplated that the controller may be in the form of a human interface board (HMI board). When the HMI board receives the electronic signal initiated from the dispenser paddle 60, the HMI board can send an electronic signal to an electronically operated valve disposed in fluid communication with the water supply line 68. Specifically, a valve assembly 77 (FIG. 5C) may be disposed anywhere along the water supply line 68 or may be incorporated into the nozzle 76 of the water dispenser assembly 50. It is contemplated that the valve assembly 77 may be operable between open and closed positions. When the second portion 64 of the dispenser paddle 60 is in the at-rest or first position, as shown in FIG. 4C, the valve assembly 77 is contemplated to be in the closed position. Once the second portion 64 of the dispenser paddle 60 is engaged by a user and moved outwardly from the at-rest or first position (FIG. 4C) to an outwardly disposed actuated or second position, the valve assembly 77 will move to the open position to allow water to be dispensed from the nozzle 76 downwardly into the receiving area 66 in a direction as indicated by arrow W (FIG. 4C). As noted above, the valve assembly 77 may be an electronic valve assembly that responds to electronic signals that are sent based on the movement of the dispenser paddle 60.

As further shown in FIG. 4C, the cavity 71 of the shelf assembly 40 is covered by the trim member 72, which, as noted above, may be an integrated portion of the panel 59 in a manner as further described below.

Figure 5A:
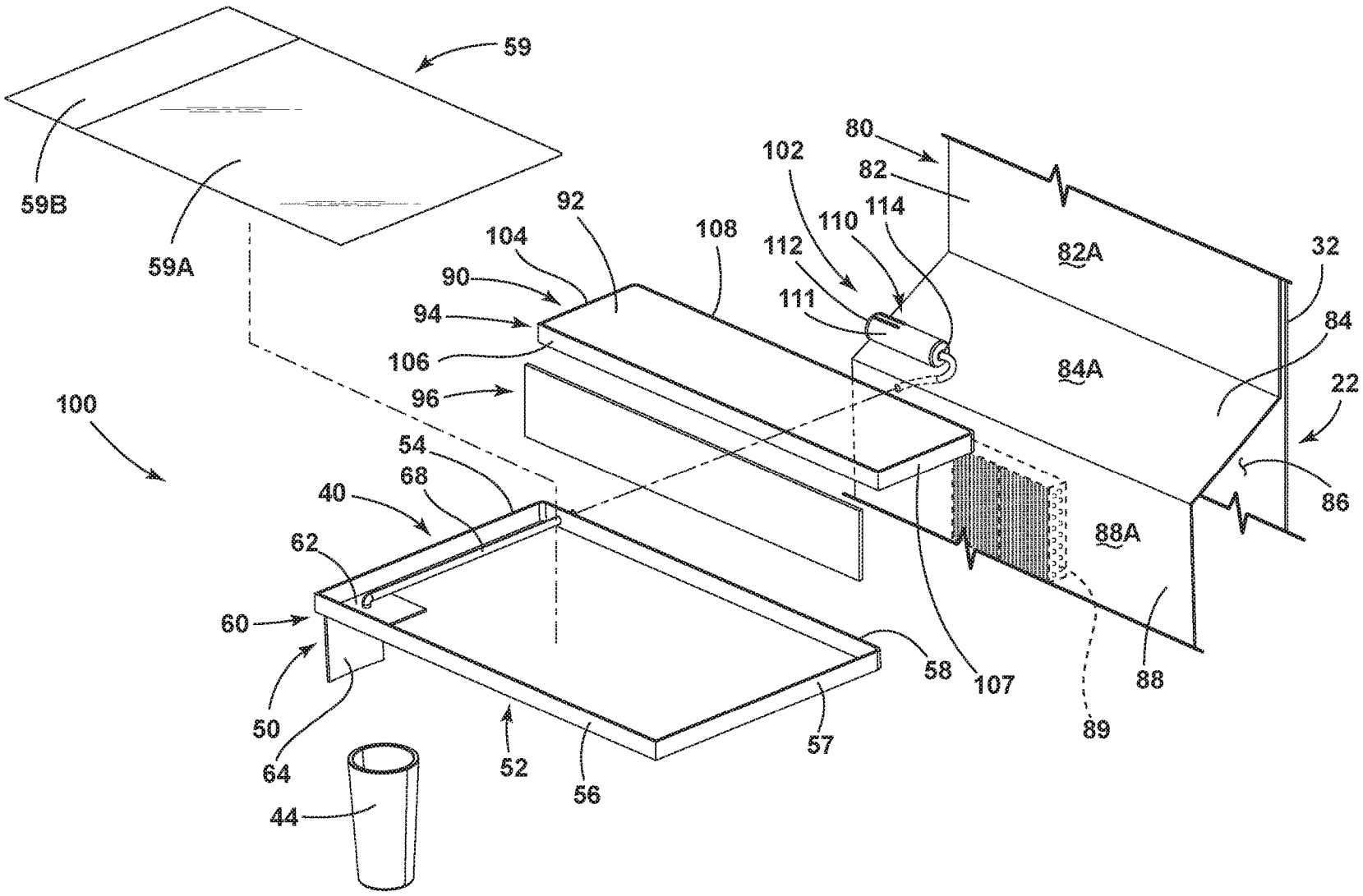
FIG. 5A is an exploded top perspective view of a shelf system having first and second shelf assemblies exploded away from a wall covering assembly.

Referring now to FIG. 5A, another embodiment of the present concept is shown, wherein a wall covering assembly 80 is disposed adjacent to the rear wall 32 of the liner 22. The wall covering assembly 80 includes an upper portion 82 and a lower portion 88 having an inwardly angled intermediate portion 84 disposed therebetween. With the inwardly angled intermediate portion 84 disposed between the upper and lower portions 82, 88, the upper and lower portions 82, 88 of the wall covering assembly 80 are vertically and horizontally offset from one another. As positioned adjacent to the rear wall 32 of the liner 22, the inwardly angled intermediate portion 84 of the wall covering assembly 80 defines a machine compartment 86. Specifically, the machine compartment 86 is disposed between the liner 22 and the wall covering assembly 80 within the refrigerator compartment 16. In use, the machine compartment 86 is contemplated to house refrigeration components of the refrigerator 10 for cooling the refrigerator compartment 16. In the embodiment shown in FIG. 5A, an evaporator 89 is shown disposed within the machine compartment 86 defined between the wall covering assembly 80 and the liner 22. The upper, lower and intermediate portions 82, 88 and 84 of the wall covering assembly 80 each include a respective outer surface 82A, 88A and 84A. Thus, in the embodiment shown in FIG. 5A, the wall covering assembly 80 (via the outer surfaces 82A, 88A and 84A thereof) defines the rear wall of the refrigerator compartment 16 as the wall covering assembly 80 covers and conceals the liner 22 and the machine compartment 86 disposed between the liner 22 and the wall covering assembly 80. As such, shelf assemblies, such as first and second shelf assemblies 40, 90 shown in FIG. 5A, will abut one of the outer surfaces 82A, 84A and 88A of the wall covering assembly 80 within the refrigerator compartment 16.

As further shown in FIG. 5A, a shelf system 100 includes shelf assembly 40 which defines a first shelf assembly of the shelf system 100. The shelf system 100 further includes a second shelf assembly 90 disposed above the first shelf assembly 40. While the shelf assembly 40 and the shelf assembly 90 are identified respectively as first and second shelf assemblies with respect to FIGS. 5A-5C, they may be claimed in an inverse order as a matter of introduction order into the appended claims, or they may be included in the present concept separate from one another.

As shown in FIG. 5A, the second shelf assembly 90 includes a frame assembly 94 which is operably coupled to a top panel 92 and a front panel 96. The top panel 92 and the front panel 96 are disposed in a substantially perpendicular configuration relative to one another. It is contemplated that the top panel 92 and the frame assembly 94 may be a unitary member of the second shelf assembly 90. The frame assembly 94 includes a first side portion 104 and a second side portion 107, as well as a front portion 106 and a rear portion 108. Much like the rear portion 58 of the first shelf assembly 40, the rear portion 108 of the frame assembly 94 of the second shelf assembly 90 is contemplated to abut the wall covering assembly 80. Specifically, the rear portion 58 of the frame assembly 52 of the first shelf assembly 40 is contemplated to abut the wall covering assembly 80 at the outer surface 88A of the lower portion 88 of the wall covering assembly 80. Similarly, the rear portion 108 of the frame assembly 94 of the second shelf assembly 90 is contemplated to abut the wall covering assembly 80 at the outer surface 82A of the upper portion 82 of the wall covering assembly 80. It is also contemplated that the frame assemblies 52, 94 of the first and second shelf assemblies 40, 90 may abut the wall covering assembly 80 at different locations without departing from the spirit of the present concept.

As further shown in FIG. 5A, the panel 59 is shown exploded away from the frame assembly 52 of the first shelf assembly 40. The panel 59 includes a first and second portions 59A, 59B. The first portion 59A of the panel 59 is contemplated to be a substantially transparent or translucent portion that is substantially clear or otherwise light transmissive. The second portion 59B of the panel 59 is contemplated to be substantially translucent or opaque to substantially or fully conceal the components of the water dispenser assembly 50. To provide a substantially concealing translucent feature to the second portion 59B of the panel 59, the glass or polymeric material making up the panel 59 may be tinted, frosted or colored to camouflage the components of the water dispensing assembly, such as the dispenser paddle 60 and water supply line 68. To provide a fully concealing opaque feature to the second portion 59B of the panel 59, the glass or polymeric material making up the panel 59 may include an opaque film or adhesive patch applied to either an upper or lower surface of the second portion 59B. The second portion 59B of the panel 59 can also be painted on upper or lower surfaces thereof to fully conceal the components of the water dispenser assembly 50, as best shown in FIG. 5B.

In the embodiment shown in FIG. 5A, a water filtration system 102 includes a water filter assembly 110 having a first end 112 and a second end 114 with a body portion 116 disposed therebetween. The body portion 116 of the water filter assembly 110 is an elongate body portion, such that the water filter assembly 110 is laterally disposed within the refrigerator compartment 16. As used herein, the term "laterally disposed" refers to an orientation of the water filter assembly 110 relative to the refrigerator compartment 16, and with particular relevance to the wall covering assembly 80 and the liner 22 of the refrigerator compartment 16. As noted above, either the wall covering assembly 80 or the liner 22 may define in the rear wall of the refrigerator compartment 16. Thus, the water filter assembly 110 of the present concept is described herein as being "laterally disposed" within the refrigerator compartment 16 as the body portion 116 of the water filter assembly 110 is disposed in a substantially parallel relationship relative to either the wall covering assembly 80 or the liner 22, whichever component makes up the rear wall of the refrigerator compartment 16, or both. In the embodiment shown in FIG. 5A, the water filter assembly 110 is shown with the body portion 116 thereof disposed in a parallel relationship to both the wall covering assembly 80 and the liner 22. This is unlike most water filter assemblies that are disposed in a front-to-back orientation within a refrigerator compartment that would be perpendicular to a rear wall of the refrigerator compartment and would also exceed a width of the second shelf assembly 90. Instead, the lateral configuration of the water filter assembly 110 of the present concept is disposed in a side-to-side orientation within the refrigerator compartment 16 as further described below.

Figure 5B:
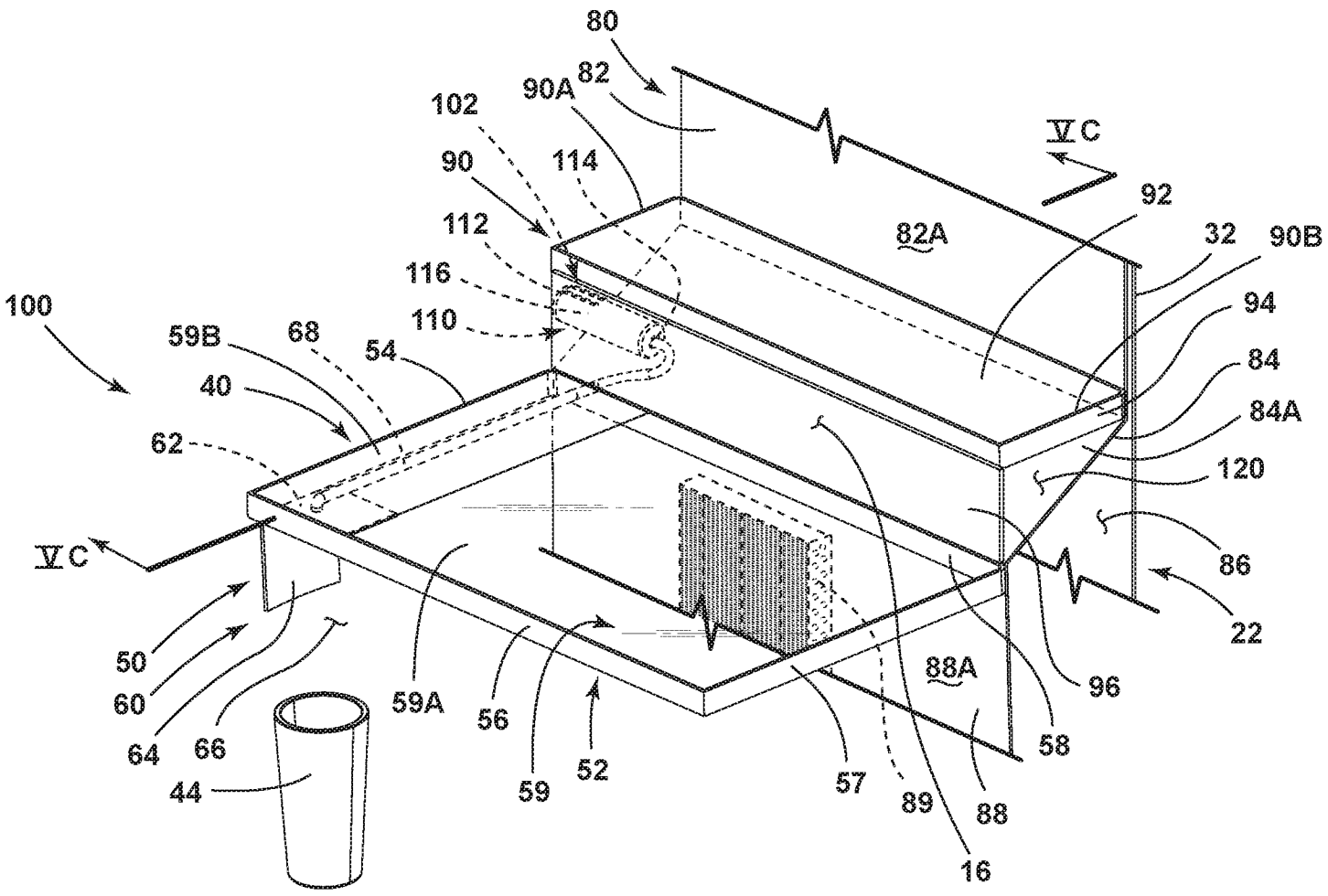
FIG. 5B is a top perspective view of the shelf system of FIG. 5A showing the first shelf assembly having an integrated water dispenser system and the second shelf assembly concealing a water filtration system.

Referring now to FIG. 5B, the first shelf assembly 40 is shown assembled against the outer surface 88A of the lower portion 88 of the wall covering assembly 80. In FIG. 5B, the panel 59 is positioned and supported on the frame assembly 52, such that the panel 59 and the frame assembly 52 cooperate to define a cavity of the first shelf assembly 40. As coupled to and supported by the frame assembly 52, the second portion 59B of the panel 59 conceals the water supply line 68 and the first portion 62 of the dispenser paddle 60, which are both shown in phantom in FIG. 5B to indicate that they are fully covered by the second portion 59B of the panel 59 in assembly. The second shelf assembly 90 is shown assembled against the outer surface 82A of the upper portion 82 of the wall covering assembly 80. As such, the second shelf assembly 90 is disposed above the first shelf assembly 40 within the refrigerator compartment 16 in the configuration of the shelf system 100 shown in FIG. 5B. The top panel 92 and front panel 96 of the second shelf assembly 90 are operably coupled to one another and cooperate with the inwardly angled intermediate portion 84 of the wall covering assembly 80 define a storage cavity 120 therebetween. The water filter assembly 110 of the water filtration system 102 is shown laterally disposed within the storage cavity 120. In this way, the second shelf assembly 90 defines a shortened shelf with regards to shelf depth that makes a novel use of a space that is otherwise a dead space. The space defined by the storage cavity 120 would normally be considered a dead or unusable space within a refrigerator compartment as the inwardly angled intermediate portion 84 of the wall covering assembly 80 makes it difficult to use the space disposed directly above the inwardly angled intermediate portion 84. When a refrigerator compartment includes an inwardly angled portion of a rear wall, such as inwardly angled intermediate portion 84 of the wall covering assembly 80 shown in FIG. 5B, the angle of the inwardly angled portion of the rear wall makes it difficult to use the space above. Thus, the refrigerator 10 of the present concept includes a machine compartment 86 disposed within the refrigerator compartment 16 that houses cooling components, such as the evaporator 89, for cooling the refrigerator compartment 16. As noted above, the machine compartment 86 is partially defined by the inwardly angled intermediate portion 84 of the wall covering assembly 80 as a top surface of the machine compartment 86. The inwardly angled intermediate portion 84 of the wall covering assembly 80 also provides a bottom surface of the storage cavity 120 disposed thereabove. As such, the refrigerator compartment 16 of the present concept includes a wall covering assembly 80 having an inwardly angled intermediate portion 84 with a storage cavity 120 disposed thereabove and a machine compartment 86 disposed therebelow.

As noted above, the storage cavity 120 is defined by the front panel 96 and top panel 92 of the second shelf assembly 90 along with the outer surface 84A of the inwardly angled intermediate portion 84 of the wall covering assembly 80. In assembly, the second shelf assembly 90 substantially conceals the water filter assembly 110 of the water filtration system 102 within the storage cavity 120. As shown in FIG. 5B, the storage cavity 120 is an elongate storage cavity substantially running the length of the second shelf assembly 90. The water filter assembly 110 of the present concept interconnects with the water supply line 68 of the water dispenser assembly 50 for providing filtered water to the receiving area 66 defined between the first and second portions 62, 64 of the dispenser paddle 60.

As further shown in FIG. 5B, the second shelf assembly 90 includes first and second ends 90A, 90B which are opposed ends of the second shelf assembly 90. Being laterally disposed within the storage cavity 120 defined between the second shelf assembly 90 and the wall covering assembly 80, the water filter assembly 110 is configured, such that the first end 112 thereof is disposed a first distance from the first end 90A of the second shelf assembly 90, while the second end 114 of the water filter assembly 110 is disposed a second distance from the first end 90A of the second shelf assembly 90 that is greater than the first distance described above. As such, the elongate body portion 116 of the water filter assembly 110 is disposed laterally within the elongate storage cavity 120 as opposed to a standard water filter assembly that is generally positioned in a perpendicular manner relative to the water filter assembly 110 shown in FIG. 5B. It is contemplated that the second shelf assembly 90 will include an access door disposed on either the top panel 92 or the front panel 96 to provide access to the water filtration system 102 for changing out or servicing the water filter assembly 110 as needed. Being a shortened shelf assembly, it is noted that the top panel 92 of the second shelf assembly 90 does not extend beyond the inwardly angled intermediate portion 84 of the wall covering assembly 80. In this way, the second shelf assembly 90 has a footprint that is limited to a size needed to conceal the water filter assembly 110 of the water filtration system 102, while still providing usable space to store items in a viewable and elevated location relative to items stored on the panel 59 of the first shelf assembly 40.

Figure 5C:
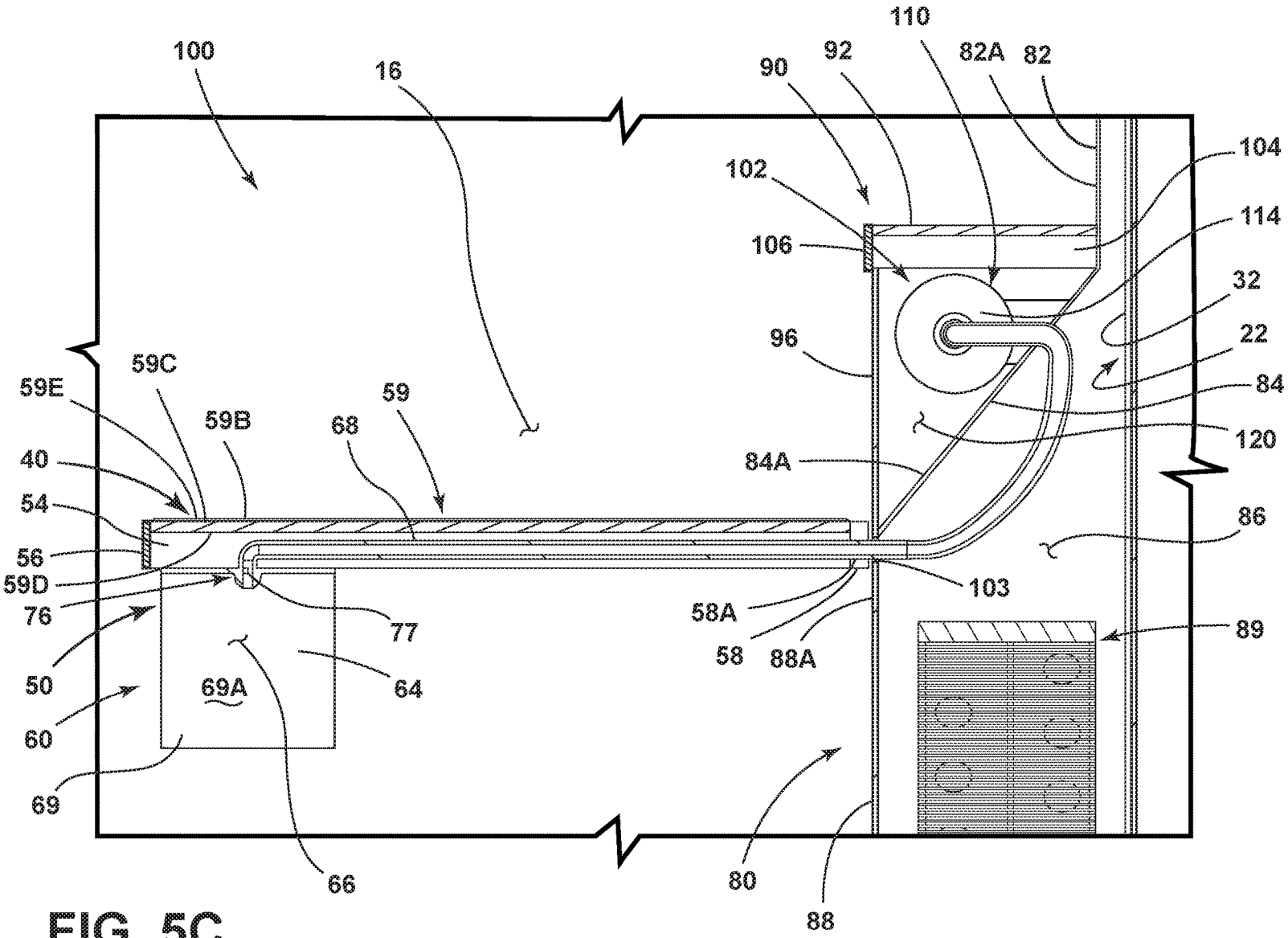
FIG. 5C is a cross-sectional view of the shelf system of FIG. 5B taken at line VC.

Referring now to FIG. 5C, the cross-sectional view of the shelf system 100 is shown wherein the second portion 59B of the panel 59 includes upper and lower surfaces 59C, 59D. In the embodiment shown in FIG. 5C, the upper surface 59C of the second portion 59B of the panel 59 includes an opaque layer 59E which may be in the form of an adhesive patch, a paint coating, a film, an etching or other like composition which would provide a layer covering the second portion 59B of the panel 59 to conceal components of the water dispenser assembly 50 disposed therebelow. As noted above, the second portion 59B of the panel 59 may also include a coloration disposed within the second portion 59B of the panel 59 that makes the second portion 59B of the panel 59 opaque. Further, it is contemplated that the opaque layer 59E may be disposed on the lower surface 59D of the second portion 59B of the panel 59 to conceal the components of the water dispenser assembly 50. As further shown in FIG. 5C, the wall covering assembly 80 includes an access aperture 103 disposed therethrough, through which the water supply line 68 enters into the machine compartment 86. It is also contemplated that the access aperture 103 may be positioned at another location along the wall covering assembly 80 directly interconnect the water supply line 68 with the water filter assembly 110 within the storage cavity 120. Thus, as shown in FIG. 5C, the water supply line 68 interconnects the dispenser paddle 60 of the water dispenser assembly 50 with the water filter assembly 110 of the water filtration system 102 to supply filtered water to the water dispenser assembly 50. As further shown in FIG. 5C, a portion of the water supply line 68 is disposed within a cavity defined between the frame assembly 52 and the panel 59 of the first shelf assembly 40.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator, comprising:

a refrigerator compartment at least partially defined by a liner having a sidewall;

a shelf assembly disposed within the refrigerator compartment and having a frame assembly supporting a panel, wherein the panel includes first and second portions, and further wherein the shelf assembly is supported on the liner such that a first side portion of the frame assembly is disposed adjacent to and parallel with the sidewall of the liner;

a dispenser paddle having first and second portions, wherein the first portion of the dispenser paddle is operably coupled to the first side portion of the frame assembly of the shelf assembly, and the second portion of the dispenser paddle extends downwardly from the first portion of the dispenser paddle, wherein the second portion of the dispenser paddle moves laterally within the refrigerator compartment between an at-rest position and an actuated position; and a water supply line operably coupled to the dispenser paddle below the second portion of the panel.

2. The refrigerator of claim 1, wherein the second portion of the panel is an opaque portion disposed over the water supply line.

3. The refrigerator of claim 2, wherein the first portion of the panel is a transparent portion.

4. The refrigerator of claim 2, wherein the frame assembly of the shelf assembly includes front and rear portions, and further wherein the water supply line extends through the rear portion of the frame assembly towards the front portion of the frame assembly.

5. The refrigerator of claim 1, wherein the second portion of the dispenser paddle moves towards the sidewall of the liner when the second portion of the dispenser paddle moves from the at-rest position to the actuated position.

6. The refrigerator of claim 1, including:

a valve assembly disposed along the water supply line, wherein the valve assembly moves to an open position when the second portion of the dispenser paddle moves from the at-rest position to the actuated position.

7. A shelf assembly, comprising:

a frame assembly having first and second side portions interconnected by front and rear portions, wherein the frame assembly further includes an intermediate member disposed between the first and second side portions and interconnecting the front and rear portions to define a cavity therebetween;

a panel supported on the frame assembly and having a portion covering the cavity of the frame assembly;

a water supply line disposed within the cavity of the frame assembly; and a dispenser paddle having first and second portions, wherein the dispenser paddle is operably coupled to the water supply line at the first portion, and further wherein the second portion of the dispenser paddle moves laterally within the refrigerator compartment between an at-rest position and an actuated position.

8. The shelf assembly of claim 7, wherein the second portion of the dispenser paddle extends downwardly below the cavity of the frame assembly.

9. The shelf assembly of claim 7, including:

a valve assembly disposed along the water supply line, wherein the valve assembly moves from a closed position to an open position when the second portion of the dispenser paddle moves from the at-rest position to the actuated position.

10. The shelf assembly of claim 7, wherein the portion of the panel covering the cavity of the frame assembly is an opaque portion concealing the water supply line.

11. A refrigerator, comprising:

a refrigerator compartment having a rear wall, wherein the rear wall includes an inwardly angled portion;

a first shelf assembly disposed within the refrigerator compartment and having a panel supported on a frame assembly to define a cavity positioned below a portion of the panel;

a second shelf assembly disposed within the refrigerator compartment, wherein the second shelf assembly includes a front panel and a top panel that cooperate with a surface of the inwardly angled portion of the rear wall to define a storage cavity therebetween;

a water filtration system having a water filter assembly laterally disposed within the storage cavity; and a water dispenser system having a dispenser paddle operably coupled to the first shelf assembly and interconnected with the water filter assembly by a water supply line.

12. The refrigerator of claim 11, wherein the portion of the panel covering the cavity of the first shelf assembly includes an opaque layer.

13. The refrigerator of claim 12, wherein a portion of the water supply line is disposed within the cavity of the first shelf assembly.

14. The refrigerator of claim 13, wherein the dispenser paddle further includes a portion extending downwardly below the cavity of the first shelf assembly.

15. The refrigerator of claim 14, wherein the portion of the dispenser paddle extending downwardly below the cavity of the first shelf assembly is operable between at-rest and actuated positions.

16. The refrigerator of claim 15, including:

a valve assembly disposed along the water supply line, wherein the valve assembly moves from a closed position to an open position when the portion of the dispenser paddle extending downwardly below the cavity of the first shelf assembly moves from the at-rest position to the actuated position.

17. The refrigerator of claim 11, wherein the storage cavity of the second shelf assembly is an elongate storage cavity, and further wherein the water filter assembly includes an elongate body portion disposed in a parallel relationship relative to the rear wall of the refrigerator compartment.

* * * * *